United States Patent [19]

Schmidt

[11] Patent Number: 4,726,616

[45] Date of Patent: Feb. 23, 1988

[54] DUMPSTER-TYPE TRASH CONTAINER

[76] Inventor: Phillip M. Schmidt, 117 Centennial St., Geneva, Ohio 44041

[21] Appl. No.: 874,719

[22] Filed: Jun. 16, 1986

[51] Int. Cl.[4] ..... B65F 1/12

[52] U.S. Cl. ..... 294/68.2; 294/68.26; 414/414

[58] Field of Search ..... 294/68.2 A, 68.1, 68.26; 414/406, 407, 408, 414, 607, 608; 100/229 A, 233; 220/1 T, 254, 255

[56] References Cited

U.S. PATENT DOCUMENTS

| | | | |
|---|---|---|---|
| 3,217,913 | 11/1965 | Aldredge et al. | 414/408 |
| 3,504,813 | 4/1970 | Weir | 294/68.26 |
| 3,669,485 | 6/1972 | Stihler | 294/68.26 |
| 4,088,071 | 5/1978 | Cruse et al. | 100/245 |
| 4,290,352 | 9/1981 | Schmidt et al. | 220/1 T |
| 4,373,849 | 2/1983 | Robinson | 294/68.26 |

*Primary Examiner*—James B. Marbert

*Attorney, Agent, or Firm*—Pearne, Gordon, McCoy & Granger

[57] ABSTRACT

A dumpster-type trash container is disclosed in which the bottom wall and the lower portion of the side walls are formed of a heavier gauge material to eliminate premature corrosion failures. In the illustrated embodiment, the lower portions of the side walls that are formed of a heavier material are inclined up from the bottom wall to a junction with the side walls above the level of liquid normally contained within the dumpster. The vertical corners are also inclined to reduce the tendency for trash to stick within the container when it is inverted for dumping. Further, the fork receiving sleeves are flared at their forward ends to provide reinforced camming surfaces to guide the forks into the sleeves and to protect the dumpster from damaging impact with the forks. The covers are provided with a latching system to retain the covers in a fully opened position to prevent accidental closure and damage to users. Such latching system is automatically released when the dumpster is inverted for dumping and remains in its released position as the dumpster is returned to its normal upright position. Two different size dumpsters are also disclosed in which the smaller dumpster can be nested within a larger dumpster for more efficient shipping.

24 Claims, 11 Drawing Figures

DUMPSTER-TYPE TRASH CONTAINER

BACKGROUND OF THE INVENTION

This invention relates generally to trash containers, and more particularly to novel and improved dumpster-type trash containers.

PRIOR ART

Various types of trash containers are known. One type, hereinafter referred to as a "dumpster-type trash container," provides a pair of similar but opposite sleeves along the sides of the dumpster into which lift forks extend when the container is to be emptied. Such forks provided on a garbage or trash truck operate to lift the dumpster up and turn it over to an inverted dump position so that the trash within the dumpster is emptied into the truck for removal. U.S. Pat. No. 4,088,071 illustrates one such dumpster design.

The typical prior art dumpster have a number of disadvantages which are eliminated with the present invention.

During use, the driver of the truck often fails to properly align the forks with the sleeves, so that the fork ends hit the ends of the sleeve or the adjacent portion of the dumpster with sufficient force to bend or rip the entry end of the sleeve or cause damage to the dumpster. Both ends of the sleeve are also occasionally torn or cracked when the dumpster is shaken during dumping by rapidly banging the lifting forks against the inside surface of the sleeves, or if the sleeves are on large or heavy dumpsters.

Liquid from the trash and rain water collects in the bottom of the dumpster, causing sufficient corrosion to the lower portion of the dumpster body to cause premature failure of the dumpster.

The sharp corners normally present in the dumpster body cause trash to collect in the corners and remain in the dumpster when it is emptied.

Large dumpsters having a rectangular shape are either so high that it is difficult to place trash therein or have such a large opening that when the dumpster is emptied, the trash tends to blow around and is not emptied neatly into the truck.

The covers are difficult to open, and sometimes fall, causing injury to the user. Further, because the dumpsters are large and bulky, they cannot be efficiently shipped to customers.

SUMMARY OF THE INVENTION

There are a number of aspects to the present invention. In accordance with the present invention, a novel and improved dumpster is provided in which the sleeves are shaped to facilitate the entry of the forks, and are structured for greater strength and to minimize damage to the sleeve and dumpster body when misalignment occurs between the sleeves and the forks when the dumpster is a large, heavy one, or when the forks are banged inside the sleeves to shake the dumpster as it is emptied.

Also, the dumpster body is provided with a bottom pan of increased thickness to resist corrosion failure without substantially increasing the weight and/or cost of the dumpster. In addition, the dumpster body is provided with angled corners in the zones where trash tends to collect, to reduce the tendency of trash to stick and remain in corner when the dumpsters are emptied. These angled corners, in addition, permit improved bracing of the corners of the dumpster for added strength without resulting in trash collecting projections within the dumpster body. The angled corners also make it possible to more easily and economically reinforce the front of the dumpster to resist impact during fork insertion. Further, they allow the provision of an enlarged sleeve opening which is more visible to the driver for alignment purposes and which results in a camming action to facilitate the entry of the forks into the sleeves.

Further, a novel and improved cover mounting system is provided allowing the use of multiple lightweight covers which can be easily opened, are self-closing under windy conditions, and which reduce the tendency for the user to be injured if a cover falls closed. Further, such cover structure is provided with a frame system which automatically latches in the open position when full access to the dumpster opening is required. Such latch system, however, automatically disengages during the dumping operation, so that when the dumpster is returned to its normal upright position, the frame structure is automatically closed.

In accordance with another aspect of this invention, a low-profile, large capacity dumpster is provided in which the access opening of the dumpster is reduced in size so that the trash is not as susceptible to blowing around during the emptying operation and the higher costs and some clearance-during-dumping problems of a larger cover are avoided. Further, such low-profile, large capacity dumpster is sized to permit a nesting with a smaller dumpster size to improve shipping efficiency.

These and other aspects of this invention are illustrated in the following drawings, and are more fully described in the following specification.

DETAILED DESCRIPTION OF THE DRAWINGS

Figure 1:
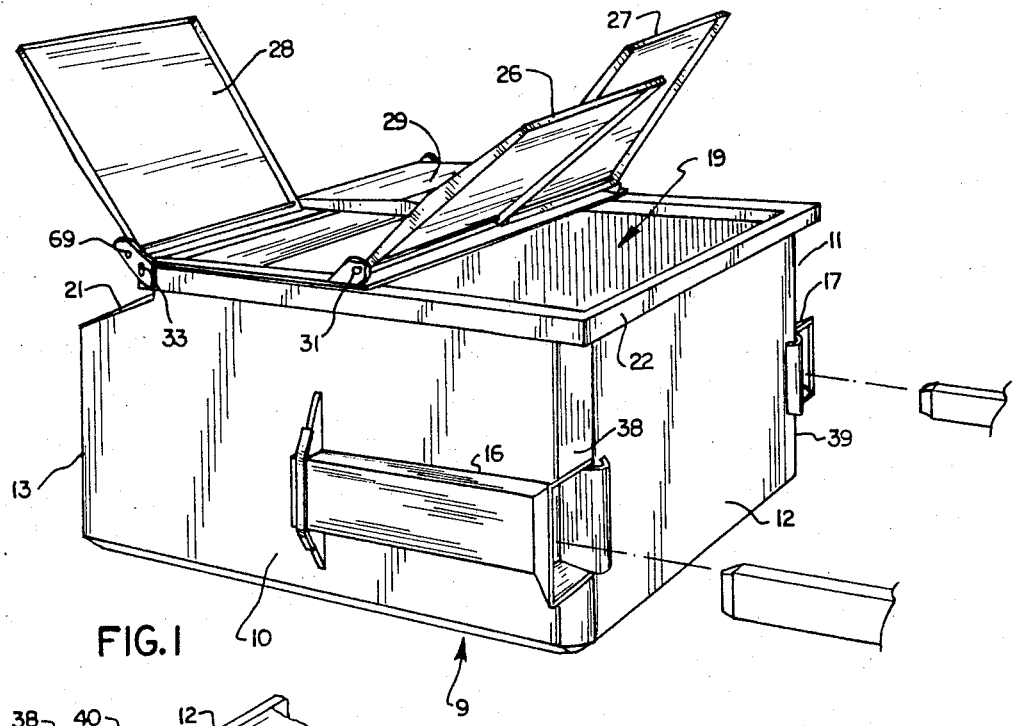
FIG. 1 is a perspective view of a low-profile, large capacity dumpster incorporating the various aspects of this invention.

FIGS. 1 through 5*b* illustrate the structural detail of a preferred embodiment of a dumpster in accordance with the present invention having a 6-to-8-yard capacity. The dumpster body itself is generally rectangular in shape providing opposed and parallel side walls 10 and 11 and opposed and parallel front and back walls 12 and 13. A bottom wall 14 completes the basic structure of the dumpster body.

Mounted along the outside of the two side walls 10 and 11 are a pair of sleeves 16 and 17 which are identical in structure but of opposite hand. The rearward ends of the side walls are sloped downwardly at 18 from the dumpster opening, and a partial top wall 21 extends forwardly and upwardly from the back wall 13 to close the dumpster in the zone rearwardly of the opening 19. A rectangular frame 22 extends around the opening 19 to stiffen the body walls around the opening and to provide a supporting structure for the lid system. Four separate lids 26, 27, 28, and 29 cooperate to provide a full closure for the opening 19. The two forward lids or covers 26 and 27 are pivoted with a pivot rod 31 on a lid frame 32 and cooperate to close the forward end of the opening. They are mounted for individual pivotal movement to an open position illustrated in FIG. 1 to provide access to the forward end of the opening 19 for the insertion of trash. The rearward pair are similarly mounted on a pivot rod 33 and, when closed, cooperate to close the rearward half of the opening 19. The pivot rod 33, in addition, pivotally supports the rearward end of the lid frame. Here again, the rearward pair of covers 28 and 29 can be individually opened to provide access to the rearward side of the opening. If desired, lids 26 and 27 could be combined as one larger lid, as could also lids 28 and 29.

Figure 6:
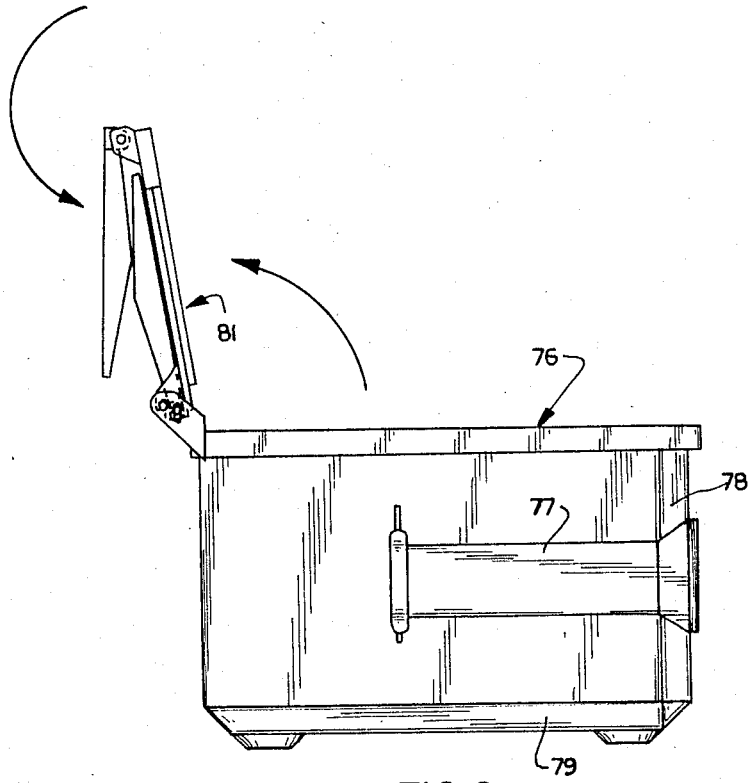
FIG. 6 is a side elevation of a smaller capacity dumpster in accordance with this invention, illustrating the cover system in the latched open position.

When it is necessary to completely open or uncover the opening 19, the covers 26 through 29 and the lid frame 32 are pivoted back, as best illustrated in FIG. 6. This pivotal movement uncovers the entire opening 19 so that large articles can be placed in the dumpster. This also occurs when the dumpster is dumped, so that the entire opening is clear to permit the trash to fall from the dumpster into the truck.

In practice, the dumpster is fabricated from heavy gauge metal by welding, and the entire dumpster, with the exception of the lids, is preferably formed of metal. The lids or covers, on the other hand, are preferably formed of a strong but relatively lightweight plastic molded part. Lightweight metal lids could be used if desired for greater fire resistance or some other reason.

Figure 3:
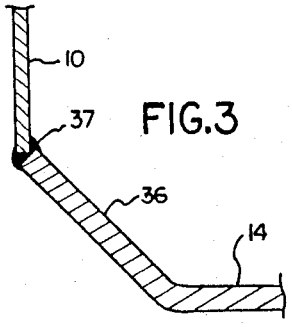
FIG. 3 is a fragmentary cross section, taken along line 3—3 of FIG. 2, illustrating the bottom pan of increased thickness.

For strength to withstand the weight of its contents and in order to minimize corrosion damage to the dumpster resulting from water or other liquids lying in the bottom of the dumpster, the bottom wall 14 is preferably made of heavier gauge material than the vertical walls 10 to 13. This is best illustrated in FIG. 3, wherein the bottom wall 14 is formed of heavier metal than the side wall 10. Preferably, the bottom wall is formed of about 3/16 inch metal and the side walls are formed of metal having a thickness no greater than about ⅛ inch. In order to confine the liquid within a heavy gauge structure, for maximum corrosion resistance, the bottom wall 14 is preferably joined to an inclined wall portion 36 extending upwardly at about 45 degrees to a total height of about 4 inches. At the extremity of the inclined portion 36 of the bottom wall, a weld joint 37 joins the inclined portion with the vertical side walls and the front and back walls. In any event, the height of the inclined portion is selected sufficient to accommodate the amount of liquid normally present within the dumpster. Therefore, any corrosion resulting from the presence of the liquid occurs in the thick-walled portion of the dumpster so that premature corrosion failure of the dumpster does not occur. Because only the bottom wall and the lower portions of the sides of the dumpster are formed of a heavy gauge material, the weight of the dumpster and its manufacturing cost are not increased excessively, even though the corrosion-damaging effect is minimized. Further, if desired, the bottom may be formed of a corrosion-resistant metal such as copper-bearing steel.

It is preferable to provide the inclined portion, since such inclined surface prevents waste materials from sticking and accumulating in the corner areas around the bottom and less heavy gauge material is required than would be required if square bottom corners were provided. Also, such structure improves the stiffness of the entire dumpster when compared to square corners at the bottom. It is, however, within the broader aspects of this invention to utilize a heavy gauge bottom wall which extends out to a right-angled corner and to extend the heavy gauge material up along the vertical side wall a sufficient distance to contain the normally encountered liquid content in the dumpster.

Referring again to FIGS. 1 and 2, the forward corners 38 and 39 are also angled at about 45 degrees to eliminate the existence of sharp corners between the front wall 12 and the side walls 10 and 11. Several advantages result from providing such angled corners. The elimination of the sharp corners at the forward end of the dumpster reduces the tendency for the trash to stick in the corners when the trash is dumped from the dumpster. Such angled corners also permit the provision of a stronger flared mouth on the forward end of the sleeves 16 and 17, as discussed in greater detail below, and allow the use of stiffening gussets 40 (illustrated in FIG. 1*a*) at the upper ends of the forward corners 38 and 39 for additional stiffening of the dumpster. Because there is less tendency for the trash to stick in the rearward corners during the dumping operation, right-angled corners are provided at the rearward corners of the dumpster.

Figure 4B:
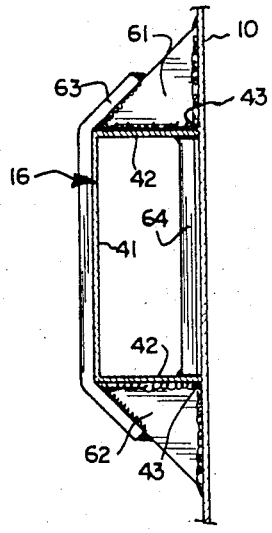
FIG. 4*b* is a fragmentary section, taken along line 4*b*—4*b* of FIG. 2, illustrating the sleeve cross section and reinforcing structure.
Figure 4C:
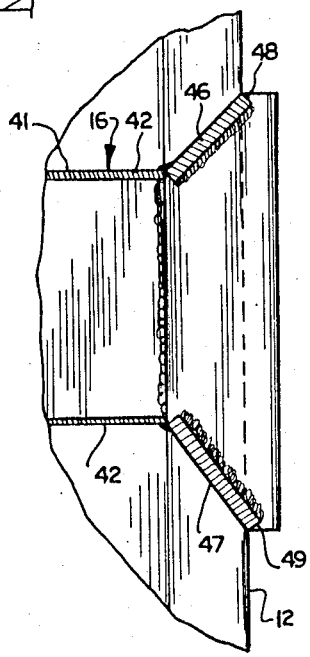
FIG. 4*c* is a fragmentary section, taken along line 4*c*—4*c* of FIG. 4*a*, illustrating the forward or open end of the sleeve.
Figure 4A:
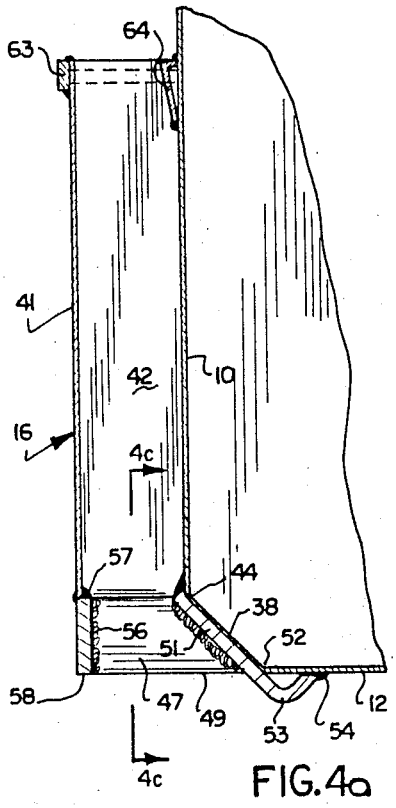
FIG. 4*a* is a fragmentary section, taken along line 4*a*—4*a* of FIG. 2, illustrating the sleeve structure.

FIGS. 4*a* through 4*c* best illustrate the structure of the sleeves 16 and 17. Since the structures of both of the sleeves are identical except that the two sleeves are of opposite hand, the structure of the sleeve 16 only will be described in detail, with the understanding that the description applies equally to the sleeve 17. The main sleeve tunnel is provided by a U-shaped channel member 41, a cross section of which is best illustrated in FIG. 4*b*. The free ends of the legs 42 of such channel member 41 are welded at 43 to the side wall 10 and in cooperation with such side wall form the principal tunnel of the sleeve. The forward end of the channel member 41 ends at the corner 44 between the side wall 10 and the inclined corner 38.

The forward end of the sleeve is provided with a flared, reinforced structure which functions to guide the forks into the main tunnel of the sleeve and to protect the sleeve and adjacent portions of the dumpster body from damage when they are impacted by the ends of a fork.

As best illustrated in FIG. 4*c*, two plate members 46 and 47 are respectively joined to the upper and lower legs 42. The upper plate 46 is inclined upwardly from the associated leg 42 to a forward edge 48 in alignment with the front wall 12. Similarly, the lower plate 47 extends downwardly from the forward edge of the associated leg 42 and also terminates at an edge 49 in alignment with the front wall 12. The two plates 46 and 47, because they are positioned at relatively steep angles in opposite directions, form a relatively large, vertical sleeve opening. Therefore, if the end of the fork is vertically misaligned with the main portion of the sleeve and engages either the plates 46 or 47, there is a camming action tending to cause automatic positioning of the fork with the associated sleeve as the fork is pressed forwardly against the dumpster.

The inner wall of the mouth of the sleeve is also flared, as best illustrated in FIG. 4*a*. Here again, a plate is provided which extends from the corner 44 inwardly along the inclined corner 38. In this instance, it is preferable to extend the plate 51 past the outer corner 52 to provide a forwardly extending rib portion 53. From its forward extremity, the plate is bent back and is welded at 54 to the forward face 12. This rib structure serves several purposes: it increases the width of the mouth of the sleeve and also provides a very rigid structure which protects the forward face 12 of the dumpster from damaging impacts. Such impacts occur if the ends of the forks impact the ribs, and also occur if the dumpster slides forward on the forks as it is tipped up during the dumping operation.

The outer vertical edge of the mouth is provided again by a separate plate 56 which is welded at 57 to the forward end of the channel 41 and extends to a forward edge 58, again aligned with the front face 12 of the dumpster. The upper and lower edges of the plate 56 are also welded to the adjacent plates 46 and 47. The plates 46, 47, 51, and 56 are all formed of heavy gauge metal, preferably from ¼ to ½-inch thick. Such heavy gauge metal can withstand substantial impact by the ends of the fork without any resulting damage. Therefore, the plates provide substantial strength and, because of the inclined position of the plates 46, 47 and 51, an enlarged opening or mouth is provided at the forward end of the sleeve which functions to cam the forks into proper position with respect to the dumpster if misaligment occurs. Further, the upward extension of the plate 46 increases the height of the mouth so that it is more readily seen by the driver as he attempts to position the forks for insertion into the sleeve.

The rearward ends of the sleeves are further reinforced and strengthened by a structure best illustrated in FIG. 4*b*. A pair of triangular gussets 61 and 62 are welded along the adjacent legs 42 of the channel and along the adjacent portions of the side wall 10 to provide good support for the associated legs 42. In addition, a strap 63 is welded along the base of the channel 41 and along a portion of the adjacent gusset to provide a very strong tie between the gussets and the channel. Since the forks generally extend through the associated sleeves when the dumpster is picked up, this gusset and strap structure provides strength to support loads at the rearward end of the sleeve and the heavy plates 46, 47, 51, and 56 cooperate to support loads at the forward end of the sleeve. Consequently, during the lifting and dumping operations, a very strong connection is provided between the forks and the sleeves at those locations where the forces are applied. The intermediate walls of the channel are not stressed to any great extent and the relatively thin gauge of such channel provides all of the strength required in the intermediate zone.

A camming plate 64 is preferably provided at the rearward end of the channel 41 along the side wall 10. Such camming plate ensures that the ends of the forks are spaced from the side wall as they extend beyond the sleeve and eliminate contact between such ends and the side wall 10. Such contact, if it were allowed to occur, would tend to cause the forks to scrape away the paint on the dumpster and produce an unsightly appearance. Further, these camming plates ensure a better centering of the dumpster between the forks and help keep the lids from hitting the sides of the truck opening when the dumpster is emptied.

Figure 5A:
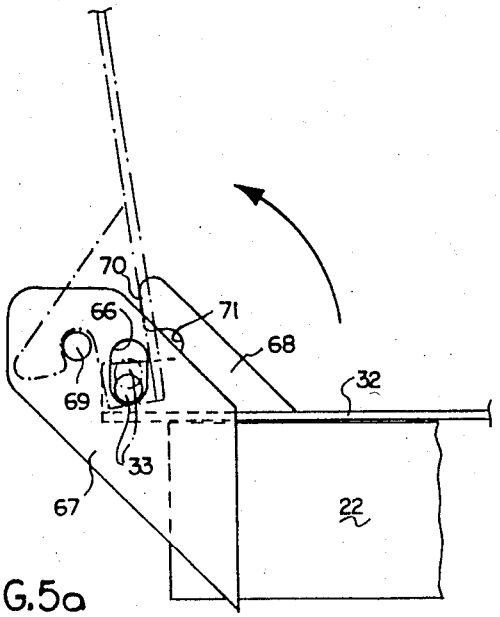
FIG. 5*a* is an enlarged, fragmentary section, illustrating the latching system for maintaining the cover frame in an open position when full access to the dumpster opening is required.
Figure 5B:
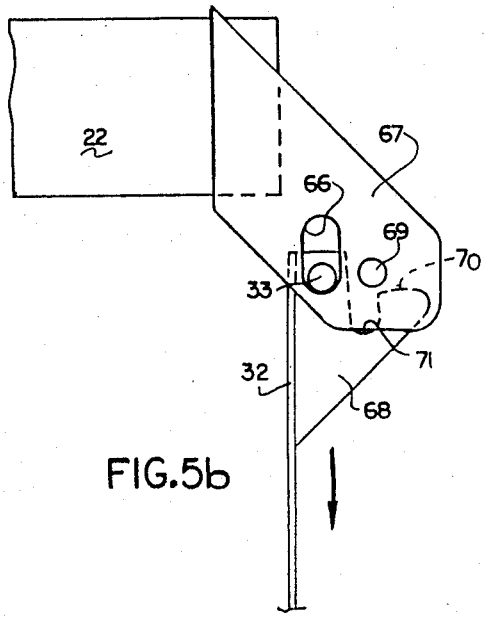
FIG. 5*b* is a similar to FIG. 5*a*, but illustrates the manner in which the latching system is released when the dumpster is inverted to empty the trash therefrom.

Reference should now be made to FIGS. 5*a* and 5*b*, which illustrate a latching system which prevents the lid frame 33 from falling back to a closed position if it is fully opened to allow full access to the opening 19 of the dumpster. This latching system would prevent accidental injury to the user by preventing the lid frame from slamming closed while the user was depositing trash therein.

As mentioned previously, the lid frame 32 is mounted for pivotal movement by a pivot rod 33, which extends across the rearward edge of the opening 19. The ends of such rod project into a vertically elongated opening 66 formed in opposed pivot plates 67. Normally, gravity maintains the pivot rod 33 at the lower end of such opening and the lids 28 and 29 (illustrated in FIG. 1) pivot about the axis of the rod in such lower position. When the lid frame 32, however, is raised to the phantom position illustrated in FIG. 5*a*, a hook projection 68 mounted on the lid frame 33 engages a fixed rod 69 mounted on the end plates 67. The initial engagement between the hooked plate 68 and the rod 69 occurs along the surface 70 and continued rotation or pivotal movement to the phantom position causes the pivot rod 33 to raise along the opening 66, as illustrated in the phantom position of such rod, until the rod 69 is positioned in alignment with a latching groove 71. When this occurs, gravity causes the lid frame 32 to drop down into the latched position illustrated in phantom, in which the pivot rod 31 again returns to the bottom of the opening. In such position, the lid frame cannot accidentally close. Closing of the lid frame prior to dumping requires lifting of the lid frame to free the latch and allow pivotal movement back to the closed position.

Figure 1A:
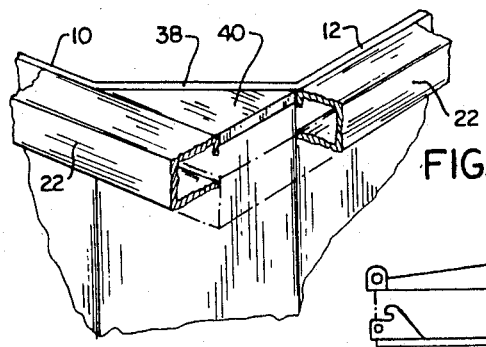
FIG. 1*a* is a fragmentary, perspective view illustrating the frame around the dumpster opening and one of the corner gussets.
Figure 2:
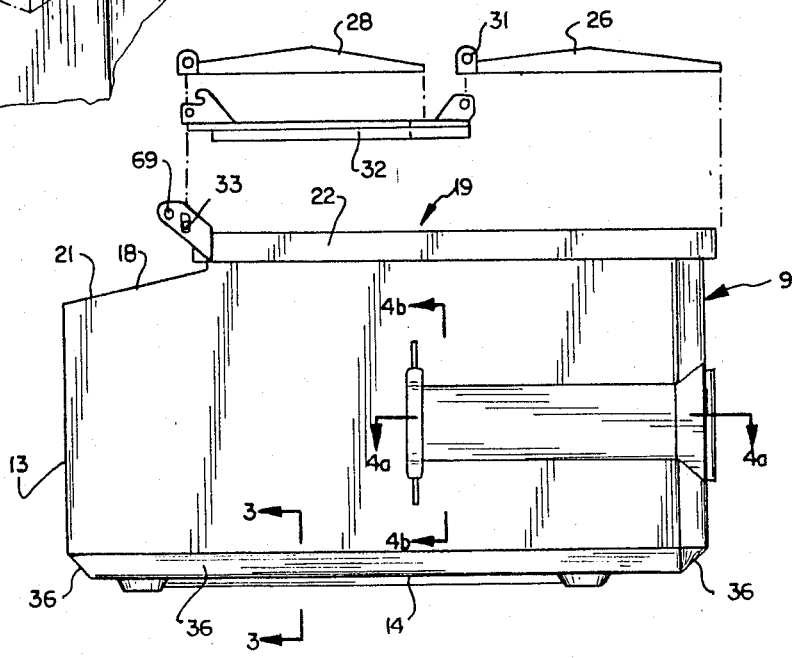
FIG. 2 is a side elevation of the dumpster illustrated in FIG. 1, with the covers and cover frame removed, and illustrated in a disassembled position for purposes of illustration.

It should be noted that the rod 69 also prevents the rearward lids 28 and 29 from falling back beyond the position illustrated in FIG. 1 with respect to the lid 28 when the rearward lids are opened without raising the lid frame 32. This makes them easier for users to close and to tend to blow shut if left open on a windy day, thereby reducing the possibility of refuse being blown out of the dumpster.

The latching system, however, automatically disengages when the dumpster is turned over during the dumping operation, as illustrated in FIG. 5*b*. Consequently, when the dumpster is turned over and is emptied, the lid frame 32 and the lids automatically pivot to an open position to allow the trash to easily fall out of the dumpster.

In such inverted position, the pivot rod 33 is moved by gravity away from the adjacent supporting frame 22 so that the lid frame cannot remain latched in the open position. Therefore, if the lid frame is closed at the time the dumpster is turned to the inverted position, it opens automatically to allow the trash to be emptied out of the dumpster. On the other hand, if the lid frame is latched open at the time the dumpster is inverted, the latch releases. Consequently, as the dumpster is returned to its normal position and deposited on the ground or other supporting surface, the lids and the lid frame automatically assume the normal closed position.

The shape of the dumpster in which the opening 19 does not extend all the way to the back wall of the dumpster is desirable, since the tendency for trash to blow around as it is being emptied into the truck is minimized. In addition, large openings require larger covers that are sometimes badly damaged or destroyed because they are too large to fit into the truck opening properly during dumping. However, because the dumpster body is longer than the opening, a low profile is provided for a given dumpster capacity. For example, the illustrated 6-yard dumpster has a total height to the top of the frame 22 of about 47½ inches. Such profile greatly eases the placement of trash in the dumpster. In such dumpster, the overall depth from front to back is about 84 inches, and the front-to-back length of the opening is about 66 inches. With the illustrated shape, even larger dumpsters can be provided with a relatively low profile. For example, an 8-yard dumpster can be built 96 inches from front to back and only about 54 inches high. If, on the other hand, the dumpster were shorter from the front wall 12 to the back wall 13 in order to maintain a relatively small opening 19 to prevent trash from blowing during the emptying operation, a higher dumpster would be required for the same volume, and it would be more difficult for the user to place trash therein.

FIG. 6 illustrates a smaller size dumpster which, again, incorporates most of the aspects according to this invention. Such dumpster 76, which has a 4-yard capacity, is again provided with sleeves 77 having the same structure as the sleeve discussed above. Similarly, it is provided with angled corners 78 at its forward end and a heavy gauge bottom 79, which is angled up at its edges in the same manner as the dumpster of FIG. 1. Further, the dumpster 76 is provided with a similar lid system 81.

Figure 7:
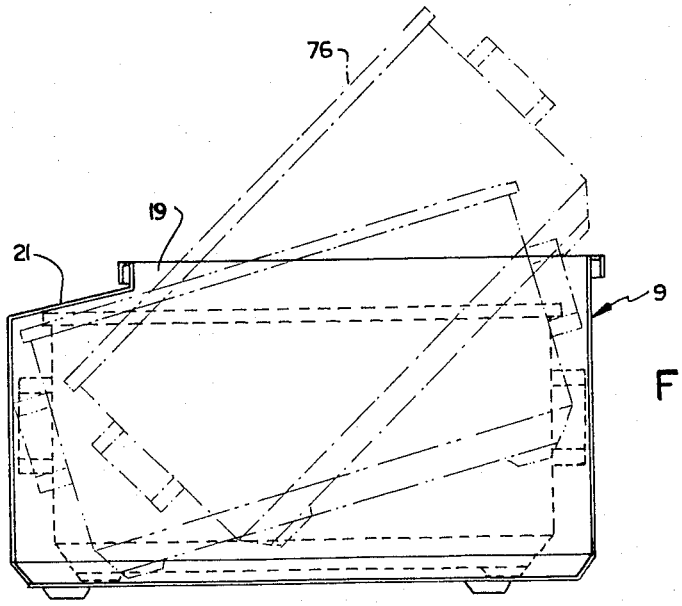
FIG. 7 is a cross section illustrating the manner in which the dumpster of FIG. 6 can be placed within the dumpster of FIG. 1 for more compact and efficient shipping.

The 6-yard dumpster of FIG. 1 and the 4-yard dumpster of FIG. 6 are sized so that the 4-yard dumpster can be positioned within the 6-yard dumpster for shipment, as illustrated in FIG. 7. The length of the 4-yard dumpster 76 is less than the width of the opening 19 in the 6-yard dumpster 9 so that when the 4-yard dumpster 76 is turned 90 degrees, it can be moved progressively as indicated in the progressive phantom positions of FIG. 7, through the opening 19, until it is fully enclosed within the 6-yard dumpster 9. When in such position, one edge of the 4-yard dumpster 76 extends under the inclined wall 21 so that it can be accommodated within the 6-yard dumpster even though the width of the 4-yard dumpster is greater than the front-to-back dimension of the opening 19. Because the 4-yard dumpster can be positioned within the 6-yard dumpster for shipment, the two dumpsters occupy the same space on the transporting vehicle, thereby reducing shipment costs. Because of the space constraints, however, the lid system of the 4-yard dumpster illustrated must be removed during such shipment in a 6-yard dumpster but can be easily reinstalled at the point of delivery. It need not be removed if shipment is inside a dumpster that is similar to the illustrated 6-yard model but slightly longer or higher, such as an 8-yard dumpster would be.

In accordance with the present invention, a number of separate and distinct advantages are achieved. The dumpster is provided with heavier plate along the bottom for greater strength and resistance to bending and so that corrosion deterioration does not cause premature corrosion failure. Since the side walls are not subjected to a similar corrosion problem, thinner-walled material is used to prevent excessive weight and excessive manufacturing costs. The sleeves are structured to assist the proper alignment of the forks as they are inserted into the sleeves and also so that the sleeves and the adjacent front wall 12 of the dumpster is not damaged excessively when the forks impact the dumpster itself. Further, a very convenient and safe-to-operate lid system is provided which reduces the likelihood of user injury. Also, the angled corners at the forward end of the dumpster and along the bottom edges reduce the tendency for trash to remain in the corners when the dumpster is emptied.

Although the preferred embodiment of this invention has been shown and described, it should be understood that various modifications and rearrangements of the parts may be restored to without departing from the scope of the invention as disclosed and claimed herein.

What is claimed is:

1. A trash container comprising a bottom wall, a pair of opposed side walls, and a pair of end walls cooperating to define a container for trash, support means for supporting said dumpster during removal of trash therefrom, said bottom wall and the lower portion of said side walls and end walls being formed of metal having a first thickness and the upper portions of said side walls and end walls being formed of metal having a second thickness substantially less than said first thickness, said metal of said bottom and side walls tending to corrode over time when exposed to rainwater and other liquids present in trash, said lower portions of said side walls and end walls having a height greater than the depth of standing liquids normally present in said container, said upper portions of said side walls normally being spaced above standing liquids in said container, said second thickness less than said first thickness reducing the amount of metal in said container and the weight thereof without reducing the corrosion resistance of said container.

2. A trash container as set forth in claim 1, wherein said bottom wall in inclined up to said side and end walls to provide said lower portion of said side and end walls.

3. A trash container as set forth in claim 1, wherein one of said end walls is a front wall and the other is a back wall, said front wall and side walls being connected by an angled portion reducing the tendency for trash to remain in the forward corners of said container when said container is emptied.

4. A trash container as set forth in claim 3, wherein said bottom wall is inclined up to said side and end walls by inclined portions and said support means are sleeves extending along walls of said container adapted to receive lift forks, said sleeves being flared at their forward end along an associated of said angled portions to provide a camming surface operable to cam forks into said sleeves.

5. A trash container as set forth in claim 3, wherein said support means are sleeves extending along said side walls adapted to receive lift forks, and said sleeves are flared inwardly at their forward ends along said angled portion to provide lateral camming surfaces operable to cam forks into said sleeves.

6. A trash container as set forth in claim 5, wherein said forward ends of said sleeves are flared vertically to provide vertical camming surfaces to cam forks into said sleeves, the remainder of said sleeves providing a substantially uniform cross section.

7. A trash container as set forth in claim 6, wherein said lateral camming surfaces and vertical camming surfaces are provided by metal plates of substantially greater thickness than the remainder of said sleeves.

8. A trash container as set forth in claim 7, wherein said side and end walls cooperate to define an opening through which trash is inserted and removed from said container, and covers are pivotally mounted to close said opening in a closed position and are pivotal to an open position for insertion and removal of trash from said container.

9. A trash container as set forth in claim 8, wherein said rearward wall provides a portion inclined forwardly to said opening so that said opening has a front-to-back dimension substantially less than the front-to-back dimension of said container.

10. A trash container as set forth in claim 9 having a capacity of substantially 6 to 8 cubic yards and a height less than about 5 feet.

11. A trash container having a capacity of about 6 to 8 cubic yards and a height of less than about 5 feet, and a front-to-back dimension of more than about 72 inches, comprising a bottom, a pair of side walls and front and back walls cooperating to define said container, said walls cooperating to define an opening through which trash is placed in said container, said container providing support means consisting of similar but opposite sleeves extending along said side walls, said sleeves being adapted to receive lift forks for inverting said container, said rearward wall providing a portion inclined forwardly to said opening so that said opening has a front-to-back dimension substantially less than the front-to-back dimension of said container.

12. A trash container as set forth in claim 11, wherein said container is formed of metal which tends to corrode over a period of time, and said bottom and lower portions of said side walls and end walls are of substantially greater thickness than the upper portions of said side walls and end walls, whereby said container provides improved corrosion resistance without requiring the increased weight and metal content that would result from increased wall thickness along said upper portions thereof.

13. A trash container as set forth in claim 12, wherein said bottom wall is inclined up to said side and end walls to provide said lower portion of said side and end walls.

14. A trash container as set forth in claim 13, wherein said front wall and side walls are connected by an angled portion reducing the tendency for trash to remain in the forward corners of said container when said container is emptied.

15. A trash container as set forth in claim 14, wherein said support sleeves extending along side walls are flared inwardly at their forward ends along said angled portion to provide lateral camming surfaces operable to cam forks into said sleeves.

16. A trash container as set forth in claim 15, wherein forward ends of said sleeves are flared vertically to provide vertical camming surfaces to cam forks into said sleeves, the remainder of said sleeves providing a substantially uniform cross section.

17. A trash container as set forth in claim 16, wherein said lateral and vertical camming surfaces are provided by metal plates of substantially greater thickness than the remainder of said sleeves.

18. A trash container as set forth in claim 17, wherein said sleeves provide a reinforcing plate extending inwardly along said angled portions and beyond said front wall to provide a rib protecting and reinforcing said front wall adjacent to said sleeve.

19. A trash container comprising a bottom, a pair of side walls, and Front and back walls cooperating to define said container, said walls cooperating to define an opening through which trash is placed in said container, said container providing support means consisting of similar but opposite sleeves extending along said side walls to receive lift forks for inverting said container, said side walls joined to said front wall by said angled portion, said sleeves flared vertically and inwardly at their forward end along said angled portion to provide vertical and lateral camming surfaces to cam forks into said sleeves, said camming surfaces provided by interconnected metal plates of substantially greater thickness than the remainder of said sleeves.

20. A trash container comprising a bottom, a pair of side walls, and front and back walls cooperating to define said container, said walls cooperating to define an opening through which trash is placed in said container, said container providing support means consisting of similar but opposite sleeves extending along said side walls to receive lift forks for inverting said container, said sleeves supported at said rearward end by triangular gusset plates joined to said rearward end of said sleeve and said side wall, and a strap extending along and joined to the adjacent portion of said sleeve between the gussets and along a portion of said gussets.

21. A pair of trash containers comprising a first generally rectangular container having a predetermined capacity, a second generally rectangular container having a smaller capacity, said first container providing an opening having a front-to-back dimension less than the front-to-back dimension of said first container and a top wall portion closing said container between one end and said opening, both of said containers providing sleeves along their sides adapted to receive lift forks, said first container having an inside front-to-back dimension greater than the overall outside side-to-side dimension of said second container, said second container having an overall outside front-to-back dimension less than the inside side-to-side dimension of said first container, said second container being sized to fit sideways through said opening of said first container to a nested position within said first container, said second container in said nested position extending beyond said opening in said first container and below said top wall portion of said first container.

22. A pair of trash containers as set Forth in claim 21, wherein said first container has a capacity of about 6 to 8 cubic yards and said second container has a capacity of about 4 cubic yards.

23. A trash container comprising a container body providing an opening through which trash is placed in and removed from said container body, cover means pivoted along one side of said opening between a fully opened position and a closed position, latch means operable to retain said cover means in said fully opened position when said container is upright, said latch means automatically releasing when said container is inverted to dump trash therefrom and remaining released as the container is returned to said upright position so that said cover means are in said closed position when said container is returned to said upright position.

24. A trash container as set forth in claim 23, wherein said latch means includes a pivot rod positioned within an elongated opening, said pivot rod normally being located in a first position within said elongated opening and moving from said first position when said latch means are latched and released.

* * * * *